United States Patent [19]

Gotoh

[11] 4,002,333

[45] Jan. 11, 1977

[54] RAINBOW PHENOMENON DEVELOPING DEVICE

[76] Inventor: Hideyuki Gotoh, 405, Shioya 1-chome, Otaru, Hokkaido, Japan

[22] Filed: Aug. 4, 1975

[21] Appl. No.: 601,305

[30] Foreign Application Priority Data

Jan. 11, 1975 Japan ..... 50-5664

[52] U.S. Cl. ..... 272/8 D; 40/106.22; 40/130 R; 52/86; 239/18; 272/8 P

[51] Int. Cl.[2] ..... F21P 1/02

[58] Field of Search ..... 272/8 R, 8 N, 8.5, 9, 272/10, 15, 25, 26, 32, 16, 17, 18, 19, 20, 8 F, 8 D, 8 P; 104/59, 69, 70, 73, 71, 72; 239/16, 17, 18, 19, 20, 274, 289, DIG. 1, 211; 40/106.21, 106.22, 125 F, 130 R, 130 C, 130 F, 130 N; 52/86

[56] References Cited

UNITED STATES PATENTS

| | | | |
|---|---|---|---|
| 757,286 | 4/1904 | Du Clos | 104/73 |
| 787,616 | 4/1905 | Evans | 239/18 |
| 858,170 | 6/1907 | Gernaert | 52/86 |
| 894,509 | 7/1908 | Leupold | 40/130 C |
| 903,004 | 11/1908 | Riehl | 239/20 |
| 1,429,077 | 9/1922 | Hotchner | 40/130 R |
| 1,626,958 | 5/1927 | Norden | 40/130 R |
| 1,747,377 | 2/1930 | Maxon | 239/18 X |
| 1,886,341 | 11/1932 | Kirk | 272/8 D X |
| 3,386,197 | 6/1968 | Elfstrom | 272/8 D X |

FOREIGN PATENTS OR APPLICATIONS

| | | | |
|---|---|---|---|
| 262,305 | 12/1926 | United Kingdom | 239/18 |

*Primary Examiner*—Paul E. Shapiro
*Assistant Examiner*—Arnold W. Kramer
*Attorney, Agent, or Firm*—Orville N. Greene; Frank L. Durr

[57] ABSTRACT

A rainbow phenomenon developing device comprising an arched structural framework defining an opening in which viewers walk, means for spraying fine water particles in the form of a mist mounted on said framework, colored transparent panels mounted on said framework in the same arrangement as that of the natural rainbow color distribution pattern, portions of said water particle spraying means extending through said panels and artificial light ray developing means mounted on said framework inwardly of and spaced from said transparent panels for illuminating the panels when energized whereby under weather conditions where the light rays of the sun are available, only the water particle spray means are operated to provide a mist atmosphere about the developing device for forming a rainbow phenomenon in cooperation with the light rays of the sun whereas under weather conditions where the light rays of the sun are not available, in addition to the operation of said water particle spray means, the artificial light ray developing means are also energized to illuminate the colored transparent panels to develop the colors in the same pattern as the natural rainbow color distribution pattern so as to form an artificial rainbow phenomenon in cooperation with the mist atmosphere developed about the device by the water particles sprayed from the water particle spray means to be observed by viewers within and outside of the device.

6 Claims, 3 Drawing Figures

RAINBOW PHENOMENON DEVELOPING DEVICE

SUMMARY OF THE INVENTION

This invention relates to a rainbow phenomenon developing device for developing a mist atmosphere formed of fine water particles in the air so as to form a rainbow phenomenon and more particularly, to a rainbow phenomenon developing device comprising an arched framework supported above the ground by means of suitable support structures and fine water particle spray means mounted on the framework for spraying fine water particles out of the device to develop a mist atmosphere about the device.

Since the thus developed mist atmosphere is desirable to be uniformly distributed throughout the entire mass of the mist atmosphere as much as possible and spread as far as possible, according to the present invention, a great number of fine water particle spray nozzles are provided in the top frames as well as the side frames of the framework with the tips of the nozzles exposed and directing outwardly of the associated frames, the nozzles are in fluid communication with a hydraulic source positioned on the ground through the associated water supply pipes and common main water pipe and water flow regulation valve are provided in the water supply pipes and main water pipe so that the water spray pattern through all the nozzles may be made uniform or varied as desired. Furthermore, according to the present invention, colored transparent panels are mounted on the side frames of the framework with the tips of the nozzles extending through and projecting out of the panels and electric lights are provided inwardly of and adjacent to the colored transparent panels to illuminate the panels when operated as desired or necessary. When the rainbow phenomenon developing device is operated under weather conditions where the light rays of the sun are available such as during daytime on fine days, only the nozzles are operated to spray water particles in the form of mist to develop a natural rainbow phenomenon in cooperation with the sun's light rays in the air about the device whereas under weather conditions where the light rays of the sun are not available such as cloudy, rainy and snowy days and during night time, the electric lights are energized to illuminate the colored transparent panels at the same time the water particle nozzles are operated so as to provide a mist atmosphere having the same color arrangement pattern as the natural rainbow in the air about the device so that viewers can observe an artificial rainbow phenomenon similar to the natural rainbow phenomenon.

The water which is employed in the water particle spray nozzles can be obtained from a water service, river or sea and alternatively, also from a water reservoir as the geography requires. However, in any case, it is necessary to employ a water source where plenty of water is always available. As the artificial light ray source, electric lights are conveniently employed and the electric lights can be simultaneously or selectively energized as desired by the provision of switches. Although the artificial light ray source is not required when the rainbow phenomenon developing device is operated under weather conditions where the light rays of the sun are available such as during daytime in fine days, when the developing device is operated under conditions where the light rays of the sun are not available such as cloudy, rainy and snowy days and during night time, the artificial light source, that is, the electric lights are employed. Since the intensity of electric lights is usually lower than that of the light rays of the sun and not capable of developing the rainbow phenomenon by the electric lights themselves, the electric lights illuminate the colored transparent panels arranged in the same color arrangement pattern as the natural rainbow phenomenon and the illuminated panels emit the rainbow colored lights which are shaded off by the fine water particles sprayed through the nozzles to thereby develop a scenery similar to the natural rainbow phenomenon. The colored panels employed in the developing device of the invention may be formed of colored glass or plastic sheets and the panels are installed on the opposite side frames of the framework of the developing device. The electric lights are provided preferably inwardly of and spaced from the panels and illuminate the panels with preferably parallel light rays therefrom by means of reflection mirrors, for example.

The colored transparent panels to be employed in the developing device of the invention are of seven different colors corresponding to the seven colors of the natural rainbow and fixedly installed in the side frames of the framework along the length of the associated side frames with the same color arrangement as that of the natural rainbow and surrounding the side frames. The electric lights are colorless and provided inwardly of and spaced from the panels. When the electric lights are energized, the lights illuminate the differently colored panels and the colored light rays, in the same color pattern as that of the natural rainbow, are emitted on the opposite sides of the framework, respectively and at the same time, the spray nozzles are operated to spray fine water particles toward the rainbow colored light rays to surround the light rays. Thus, the fine water particles shade off the light rays so as to provide faint colors similar to those of the natural rainbow.

When the colorless and milk-white glass or plastic sheets are employed as the transparent panels, the electric lights should be of different colored lights which are arranged in the same pattern as that of the natural rainbow and provided in the same manner as described in connection with the colorless electric lights for use with the colored panels. In case the colored electric lights are employed, it is necessary to provide a light insulation partition between adjacent electric lights so that the light rays emitted from the adjacent electric lights may not interfere with each other. In this way, when the colored electric lights are energized to illuminate the colorless transparent panels, the light rays arranged in the same pattern as that of the colors of the natural rainbow and emitted on the opposite sides of the developing device and shaded off by the fine water particles sprayed from the nozzles to thereby provide a scenery similar to that of the natural rainbow.

Since the rainbow usually appears high in the air and the purpose of the present invention is to provide a rainbow phenomenon developing device by which viewers can observe the rainbow, the developing device should be installed high in the air. In order to reduce the installation expenditure of the developing device, the developing device preferably utilizes two existing multi-storey building built with a space therebetween as the support structures for the legs of the arched framework of the arched developing device and the underside of the apex of the arched framework is upheld by a supporting structure such as a steel tower which is built at a midpint of in the space between the buildings. When the developing device is desired to be installed in a scenic place where a valley is surrounded on the opposite sides by precipices, the opposite ends of the arched framework are fixedly secured to the precipices so that the framework spans the valley without any intermediate upholding structures such as a steel tower which is necessary where the developing device is installed between two multi-storey buildings. In short, the developing device is preferebly installed as high as possible in the air.

Although the framework of the developing device may have a square, circular or any other cross-section as desired, the framework is required to have strength sufficient to withstand high winds.

Therefore, according to the present invention, the framework of the developing device comprises steel frames assembled to constitute a structure having an arc shape as seen in side elevation, and a plurality of water spray nozzles extending through and outwardly of the opposite sides of the framework and arranged to be supplied with water from a high capacity pump positioned on the ground and spray the water in fine particles whereby a mist atmosphere is provided about the framework. In order that the water spray pattern through the nozzles may be varied depending upon the direction of wind, the nozzles are grouped into a plurality of groups, a water supply pipe is connected to the nozzles in each of the plural groups, a water flow regulation valve is provided in each of the water supply pipes and a manual or remote controlled means is provided common to the valves so that the water supply pattern through the nozzles can be varied as desired.

Since the electric lights are provided inwardly of and spaced from the transparent panels, the electric lights illuminate the panels uniformly.

The water spray nozzles are connected at the inner ends to the associated water supply pipes positioned inwardly of and spaced from the transparent panels and the outer or tip ends of the nozzles project outwardly of the panels. With this arrangement of the nozzles, the water supplied to the nozzles from a pump through the common main pipe and associated water supply pipes is sprayed in fine particles through the nozzles into the space about the developing device to form a mist atmosphere about the device.

According to the present invention, there has been provided a rainbow phemomenon developing device which comprises in combination an arched framework secured at the opposite ends to spaced support structures and upheld at the apex by an intermediate upholding means and including a pair of spaced and parallel side frames and an arched top frame connecting the upper ends of said side frames, colored transparent panels surrounding said side frames in a spaced and parallel relationship to the side frames, illumination means mounted on said side frames for illuminating said transparent panels, water supply pipes positioned between said side frames and panels, and a plurality of fine water particle spray nozzles extending from said water supply pipes through said panels for spraying fine water particles in a mist form so as to provide a mist atmosphere about said framework Whereby a rainbow phenomenon is developed about the framework when said mist atmosphere is struck upon by the light rays from said illumination means.

The above and other objects and attendant advantages of the present invention will be more readily apparent to those skilled in the art from a reading of the following detailed description in conjunction with the accompanying drawings which show one preferred embodiment of rainbow phenomenon developing device of the present invention for illustration purpose only, but not for limiting the scope of the same in any way.

BRIEF DESCRIPTION OF THE DRAWINGS

The accompanying drawings show one preferred embodiment of rainbow phemomenon developing device constructed in accordance with the principle of the present invention and in which.

PREFERRED EMBODIMENT OF THE INVENTION

Figure 1:
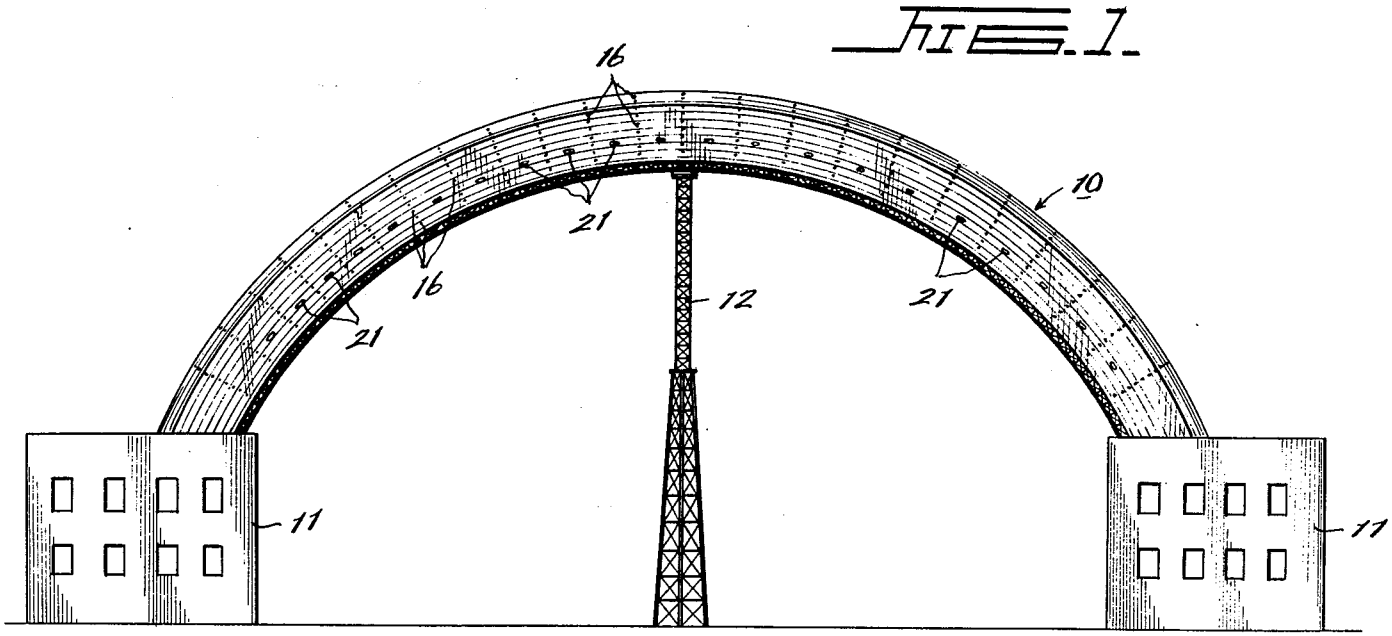
FIG. 1 is a side elevational view of said rainbow phenomenon developing device spanning a space defined between two support structures.
Figure 2:
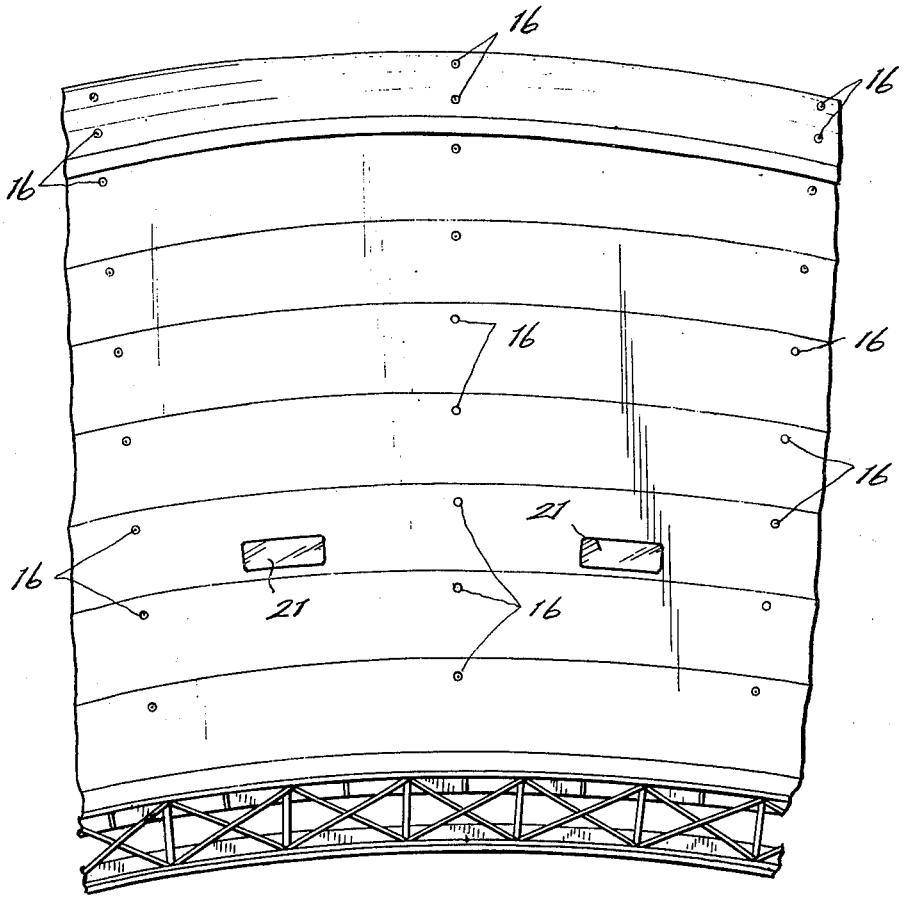
FIG. 2 is a fragmentary side elevational view on an enlarged scale of a part of said developing device of FIG. 1.
Figure 3:
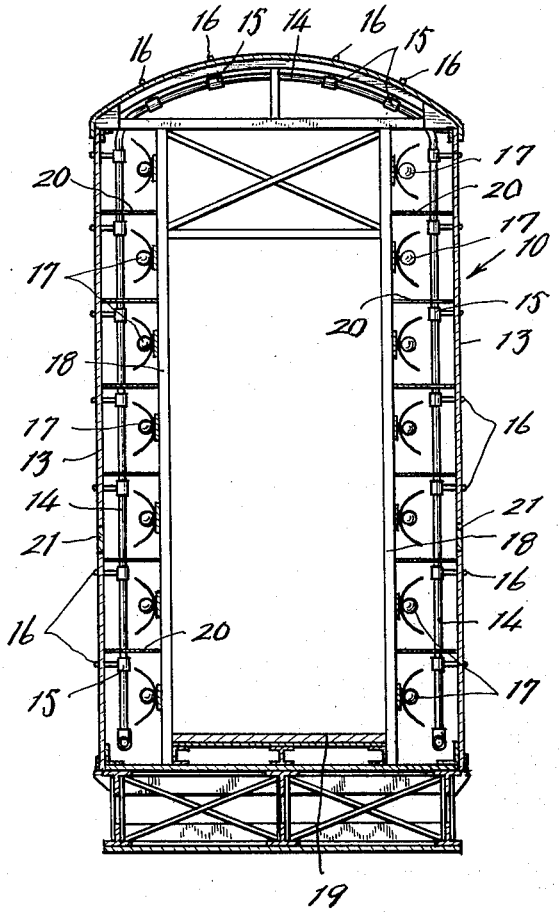
FIG. 3 is a cross-sectional view on an enlarged scale of said developing device of FIG. 1.

The present invention will be now described referring to the accompanying drawings which show one preferred embodiment of rainbow phenomenon developing device constructed in accordance with the present invention. The developing device having an arched configuration is generally shown by reference numeral 10 and spans a space defined between two support structures such as buildings 11, 11 which serve as support bases for the opposite ends of the developing device. The underside of the apex of the arched developing device 10 is upheld by a support structure in the from of a steel tower 12 positioned in the midpoint of the space defined between the buildings 11, 11. Although not shown for the clarification of the showing, the developing device 10 is constitued by a steel framework including a pair of spaced and parallel side frames and an arched top frame which connects the upper portions of the side frames to define an elongated cross-section opening therebetween. Transparent panels 13 are secured to the side frames by suitable securing means and a plurality of parallel and spaced water supply pipes 14 are provided along the transparent panels 13 in a spaced relationship to the inner side of the associated panels 13, respectively and each of the water supply pipes has a plurality of branch pipes 15 from each of which a nozzle 16 extends with the tip of the nozzle extending through the associated transparent panel 13. The water supply pipes 14 are supplied with water from a common water supply source (not shown) under the control of water flow regulation valves (not shown) provided in the respective water supply pipes 14. The nozzles 16 spray the water in fine particles which in turn form a mist atmosphere around the framework.

When the rainbow phenomenon developing device is operated under weather conditions where the light rays of the sun are available, the fine water particles provide a rainbow phenomenon. However, under conditions such as rainy, snowy and cloudy and at night where the light rays of the sun are not available, the developing device must rely upon articifial illumination means such as electric lights and transparent panels which are lit with the electric lights when the device is desired to perform its intended function.

Therefore, in the illustrated embodiment of the rainbow phenomenon developing device, the side panels are formed of colored panels each of which is tinted with one of the seven different colors corresponding to the colors of the naural rainbow and a plurality of colorless electric lamps 17 are provided on the side support panels 18 which are positioned inwardly of and spaced from the water supply pipes 14. The electric lamps 17 are supplied with electric current from a common power source (not shown) and when energized, the lamps emit light rays which in turn pass through the differently colored transparent panels 13 to illuminate the area about the developing device and at the same time, the water supply pipes 14 are supplied with water which is in turn sprayed through the nozzles 16 in the form of fine particles. The thus sprayed water particles surround the colored light rays from the lamps to thereby shade off the light rays to give an appearance similar to the natural rainbow phenomenon.

The electric lamps 17 which are separated from each other by partitions 20 are grouped into a plurality of groups each of which is provided with a common switch (not shown) and the lamp groups are electrically connected to a common main switch so that the groups of the lamps may be simultaneously enegized or selectively energized as desired.

A passage having a floor 19 is formed between the side support panels 18 of the developing device so that viewers can move within the developing device and if a portion of the colored transparent panels is formed colorless or clear at 21 at a height substantially corresponding to the height of the viewers' eyes, the viewers can observe the rainbow pehnomenon and/or the scenery adjacent to and far away from the developing device through the colorless portion while they are moving within the device along the floor 19. The floor 19 may be a moving belt or escalator.

In the foregoing description has been made of only one embodiment of the invention, but it will readily occur to those skilled in the art that the same is illustrative in nature, but does not limit the scope of the invention is any way. The scope of the invention is only limited by the appended claims.

What is claimed is:

1. A rainbow phenomenon developing device comprising an arched framework secured at the opposite ends to spaced support structures and upheld at the apex by an intermediate supporting means and including a pair of spaced and parallel side frames and an arched top frame connecting the upper portions of said side frames, a plurality of differently colored transparent panels surrounding said side frames in a spaced and parallel relationship to the side frames, illumination means mounted on said side frames for illuminating said transparent panels, from within, water supply pipes positioned between said side frames and panels and a plurality of fine water spray nozzles extending from said water supply pipes through said panels for spraying fine water particles in a mist form so as to provide a mist atmosphere about said framework whereby a rainbow phenomenon is developed about the framework when said mist atmosphere is struck upon by the light rays from said illumination means which have passed through said colored transparent panels.

2. The rainbow atmosphere developing device as set forth in claim 1, in which said colored panels include seven different colored panels each having one color corresponding to one of the colors of the rainbow and said illumination means emit colorless light rays.

3. The rainbow phenomenon developing device as set forth in claim 1, wherein said framework defines a passage having a floor at the bottom thereof along which viewers walk within said developing device.

4. The rainbow phenomenon developing device as set forth in claim 1, in which said colored transparent panels are formed of glass.

5. The rainbow phenomenon developing device as set forth in claim 1, in which said colored transparent panels are formed of plastic.

6. The rainbow phenomenon developing device as set forth in claim 1, in which said illumination means comprise electric lamps.

* * * * *